US006381805B1

(12) United States Patent
Martin

(10) Patent No.: US 6,381,805 B1
(45) Date of Patent: May 7, 2002

(54) VACUUM CLEANING ATTACHMENT TOOL

(76) Inventor: Lyle E. Martin, 10601 N. 5 Rd., Brampton, MI (US) 48937

( * ) Notice: Subject to any disclaimer, the term of this patent is extended or adjusted under 35 U.S.C. 154(b) by 0 days.

(21) Appl. No.: 09/552,096

(22) Filed: Apr. 19, 2000

Related U.S. Application Data

(60) Provisional application No. 60/130,973, filed on Apr. 26, 1999.

(51) Int. Cl.[7] ..... A47L 9/02
(52) U.S. Cl. ..... 15/415.1; 15/416
(58) Field of Search ..... 15/415.1, 416, 15/417

(56) References Cited

U.S. PATENT DOCUMENTS

| | | | | | |
|---|---|---|---|---|---|
| 963,049 | A | * | 7/1910 | Kenney | 15/415.1 |
| 1,404,888 | A | * | 1/1922 | Owen | 15/415.1 |
| 1,762,142 | A | * | 6/1930 | Breton | 74/473.15 |
| 1,768,616 | A | * | 7/1930 | Lee | 15/414 |
| 2,048,273 | A | * | 7/1936 | Ljungquist | 15/416 |
| 2,091,290 | A | * | 8/1937 | Replogle | 15/393 |
| 2,624,064 | A | * | 1/1953 | Snyder | 15/417 |
| 3,220,042 | A | * | 11/1965 | Harrington, Sr. | 15/325 |
| 3,273,188 | A | * | 9/1966 | Levack | 15/1.7 |
| 3,708,824 | A | * | 1/1973 | Holubinka | 15/416 |
| 3,816,872 | A | * | 6/1974 | Bayles et al. | 15/417 |
| 3,895,407 | A | * | 7/1975 | Parise | 15/416 |
| 3,936,903 | A | * | 2/1976 | Johnson | 15/416 |
| 4,161,802 | A | * | 7/1979 | Knight et al. | 15/331 |
| 4,198,727 | A | * | 4/1980 | Farmer | 15/416 |
| 4,413,372 | A | * | 11/1983 | Berfield | 15/414 |
| 5,077,862 | A | * | 1/1992 | Rench | 15/384 |
| 6,029,310 | A | * | 2/2000 | Besel | 15/322 |
| 6,039,817 | A | * | 3/2000 | Payne | 15/416 |

* cited by examiner

*Primary Examiner*—Robert J. Warden, Sr.
*Assistant Examiner*—Theresa T. Snider
(74) *Attorney, Agent, or Firm*—Weiner & Burt, P.C.; Irving M. Weiner; Pamela S. Burt

(57) ABSTRACT

A vacuum edge cleaning attachment tool which enables the user to walk upright while vacuum cleaning an edge between the floor an a wall. The tool has an angled suction port which is guided by two orthogonal surfaces while cleaning the intersection area between the floor and the wall.

20 Claims, 1 Drawing Sheet

FIG 1
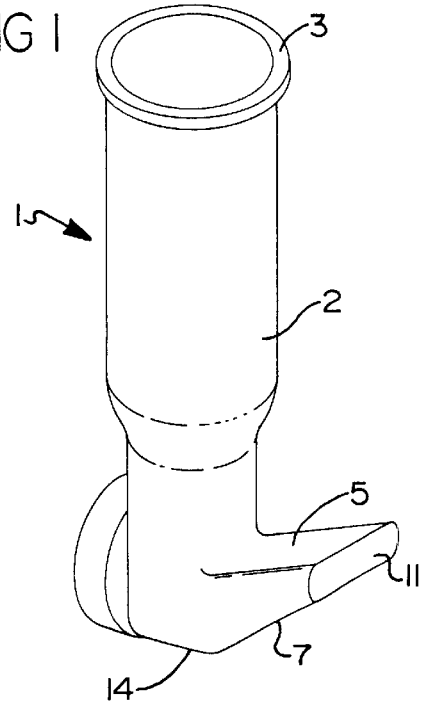
FIG 2
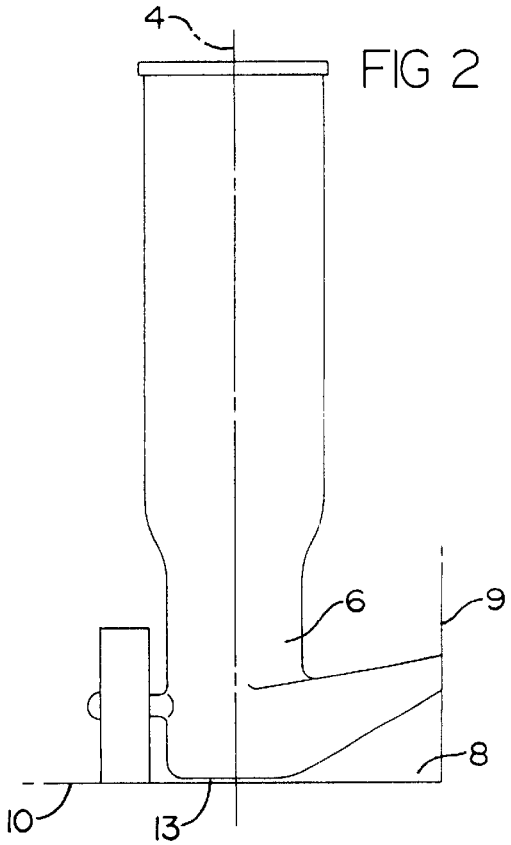
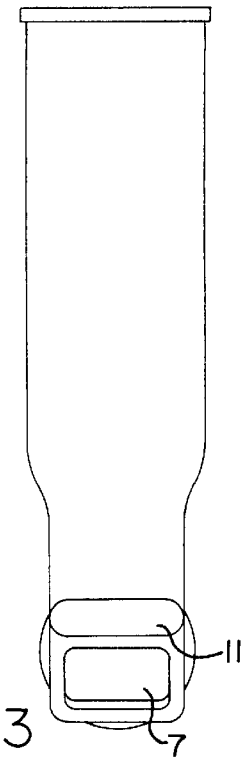
FIG 3
FIG 4
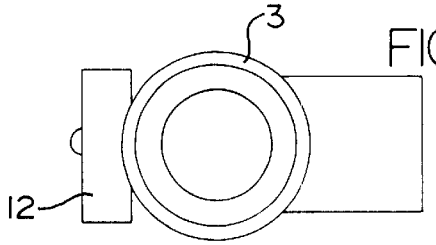
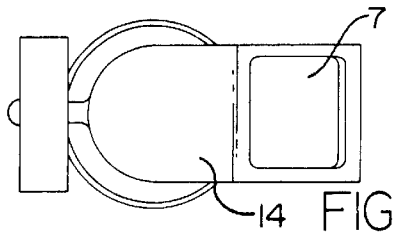
FIG 5

VACUUM CLEANING ATTACHMENT TOOL

The present application claims priority from United States Provisional Patent Application, Ser. No. 60/130,973 filed on Apr. 26, 1999.

The present invention relates generally to attachment devices for vacuum cleaners. More particularly, the present invention relates to an attachment tool for a vacuum cleaner to facilitate the cleaning of inconvenient and/or hard-to-reach places, such as wall and floor edges, door frames, window frames, etc., wile avoiding stooping and/or bending by the person using the attachment tool.

DESCRIPTION OF THE RELEVANT ART

U.S. Pat. No. 1,762,142 issued in 1930 to Breton entitled "VACUUM CLEANING MACHINE" discloses the use of wheels in conjunction with a long, narrow suction slot.

U.S. Pat. No. 1,768,616 issued in 1930 to Lee entitled "DOMESTIC APPLIANCE" discloses a nozzle for cleaning restricted spaces under furniture and the like. The nozzle is adjustably supported by rollers.

U.S. Pat. No. 2,091,290 issued in 1937 to Replogle entitled "REVERSIBLE FLOOR TOOL AND POLISHING ATTACHMENT" discloses a mouth of a nozzle which is preferably elongated. Another mouth is reduced in size and is used for special cleaning purposes wherein a concentrated swift movement of air is required. The floor tool is supported by end rollers.

U.S. Pat. No. 3,220,042 issued in 1965 to Harrington, Sr. entitled "CLEANING NOZZLE" discloses a nozzle for use in cleaning baseboard radiant heat units. A flat, generally triangular hollow housing has a top wall with a downwardly stepped portion having a resilient bumper thereon.

U.S. Pat. No. 3,273,188 issued in 1966 to Levack entitled "VACUUM HEAD FOR SWEEPING SWIMMING POOLS" discloses a vacuum head having downwardly directed edge flanges positioned about ⅛ inch below the under surface of a platform, and spaced by wheels approximately ⅛ inch above the bottom surface of the pool, thus leaving a ⅛ inch access opening around the head through which water and pool bottom deposits may be sucked.

U.S. Pat. No. 3,936,903 issued in 1976 to Johnson entitled "VACUUM CLEANER SUCTION TOOL" discloses a lever for selectively positioning a closure portion of a valve across one opening or another opening as desired. By disposing the valve across one opening, a high suction force is applied through a duct passage to an edge inlet portion whereby somewhat improved cleaning action is effected at the edge of the vacuum cleaner nozzle.

U.S. Pat. No. 4,198,727 issued in 1980 to Farmer entitled "BASEBOARD DUSTERS FOR VACUUM CLEANERS" discloses a vacuum cleaner provided with holding devices on the sidewalls of its housing on which brushes can be mounted which enable baseboards in a room to be dusted while the vacuum cleaner is being moved about to clean the carpet.

U.S. Pat. No. 4,413,372 issued in 1983 to Berfield entitled "SHOE ATTACHMENT FOR WET/DRY ELECTRIC VACUUM CLEANER" discloses a shoe attachment for insertion in the intake orifice of an electric vacuum cleaner which includes a housing having an intake orifice at the underside thereof Wheels support the housing and raise the intake orifice of the surface to be cleaned. The shoe attachment is detachably fitted in the intake orifice. The shoe attachment has an undersurface which rides along the surface to be vacuum cleaned.

U.S. Pat. No. 5,077,862 issued in 1992 to Rench entitled "CARPET CLEANING MACHINE WITH EDGE-MOUNTED VACUUM NOZZLE" disclose a carpet cleaning machine provided with front and rear counter-revolving brushes for stroking substantially-dry carpet cleaning granules into and across the carpet fibers. A shroud is mounted adjacent the brushes and has a front portion and a rear portion, each of which is spaced from its adjacent brush to define a granule passage through which granules cast by the counter-revolving brushes are re-deposited on the carpet. Each such portion also has an edge spaced above the carpet to define a granule exit opening between the edge and the carpet.

The conventional devices and techniques, as exemplified by the prior art patents discussed hereinabove, fail to provide an attachment tool which accomplishes easy edge cleaning with no stooping and/or bending required by the person doing such cleaning.

It is a desideratum of the present invention to provide such an attachment tool, while avoiding the animadversions of the prior art and conventional devices and techniques.

SUMMARY OF THE INVENTION

The present invention provides a novel and greatly improved vacuum edge cleaning attachment tool which includes a substantially hollow main body member having a central elongated axis. The tool also includes a suction port portion which extends from one side of the main member and which is disposed substantially transverse to said axis. The tool further includes at least one roller member which is disposed on a side of the main member which is substantially opposite said one side of the main member.

A primary object of the present invention is to provide a novel vacuum edge cleaning attachment tool which permits quick and easy edge cleaning, as well as door frame, window frame, and ceiling edge cleaning.

Another object of the present invention is to provide such a tool which is also provided with a beveled suction port.

A further object is to provide a tool as described hereinabove and which has a no-drag wheel design.

Yet another object is to provide a tool as described herinabove and which is approximately six inches long.

A further object is to provide a tool as described hereinabove and which fits most vacuum cleaners.

Another object is to provide such a tool which is very effective with commercial back pack vacuum equipment.

A still further object is to provide such a tool and wherein the roller or wheel design allows for drag free movement along floors, walls, door frames, ceilings, etc.

Another object is to provide such a tool which allows the user to do edge cleaning in an upright position.

A further object is to provide such a tool which permits the user to guide it along a wall while walking upright.

Another object is to provide such a tool which requires no stooping and/or bending by its user.

A further object is to provide such a tool which drastically cuts down the time required to do edge cleaning.

Other objects, features and advantages of the present invention will become apparent to those persons skilled in this area of technology and to persons familiar with vacuum cleaning when reading the following detailed description taken in conjunction with accompanying drawings.

BRIEF DESCRIPTION OF THE DRAWINGS

FIG. 1 is an isometric illustration of a preferred embodiment of the invention.

FIG. 2 is a side elevational view of the FIG. 1 embodiment shown positioned near the intersection of a wall and the floor.

FIG. 3 is a front elevational view of the FIG. 1 embodiment looking toward the suction port.

FIG. 4 is a top plan view of the FIG. 1 embodiment.

FIG. 5 is bottom view of the FIG. 1 embodiment.

DETAILED DESCRIPTION OF THE PREFERRED EMBODIMENTS

In the exemplary embodiment of the invention as illustrated in the drawings, the tool 1 has a stem or main body member 2 which has a portion 3 that attaches, for example, to a vacuum accessory hose (not shown). The stem 2 preferably, but not necessarily, has a central elongated axis 4.

A suction port portion 5 extends from one side 6 of the tool 1, and is disposed preferably, but not necessarily, substantially transverse to the central elongated axis 4 of the stem 2. The suction port portion 5 preferably, but not necessarily, is provided with a beveled or angled suction port 7 for vacuum cleaning an edge area 8, such as near the intersection of a wall 9 and a floor 10 as illustrated in FIG. 2. The suction port portion 5 includes at least one guide contact portion 11 which moves along in contact with the wall 9 as the user moves the tool 1 and as the edge area 8 is being vacuum cleaned.

The tool 1 also includes at least one wheel or roller 12 which preferably, but not necessarily, is positioned remote from the guide contact portion 11 of the suction port portion 5. The wheel 12 at least partially supports the tool 1 in such a manner that preferably, but not necessarily, a predetermined gap or space 13 is provided between the end portion 14 of the tool 1 and the surface upon which the wheel 12 rolls along, which in FIG. 2 is the floor 10. This predetermined gap 13 minimizes friction and resistance to easy movement of the tool 1, but must be small enough to also minimize loss of suction at the edge area 8 to be vacuum cleaned.

Optionally, the wheel arrangement may be such as to bring the end portion of the tool 1 very close to or lightly in contact with the surface 10 upon which the wheel 12 rolls along, but not in tight contact with such surface 10. Such surface may alternatively be a ceiling, a door frame, etc.

The novel wheel design allows for drag-free movement of the tool 1 along floors, walls, door frames, window frames, ceilings, etc.

The tool 1 allows the user to do edge vacuum cleaning in an upright position, without stooping and/or bending. One of the features which permits this is the relative orientation between contact plane of the guide contact portion 11 and the plane of the surface 10 upon which the wheel 12 rolls along. Preferably, but not necessarily, the relative orientation between such planes is substantially orthogonal.

The tool 1 can be manufactured in various sizes. Preferably, but not necessarily, the longest dimension of the tool 1 is in the range of from five inches to twelve inches.

The foregoing description of some preferred embodiments of the present invention is intended to be illustrative and exemplary only, and not limited or restrictive. It is to be understood that various modifications, variations and changes of the features of the present invention will occur to those persons skilled in this area of technology and to others, and that such modifications, variations and changes are embraced by the present invention and the accompanying claims.

What is claimed is:

1. A vacuum edge cleaning attachment tool, comprising:

a substantially hollow main body member having a central elongated axis:

a suction port portion which extends from a first side of said substantially hollow main member and which is disposed substantially transverse to said central elongated axis thereof; and at least one roller member which is disposed on a second side of said substantially hollow main member which is substantially opposite said first side of said substantially hollow main member.

2. The tool according to claim 1, wherein:

said suction port is beveled.

3. The tool according to claim 1, wherein:

said main body member is provided with an exterior end portion which is disposed between said first and second sides of said substantially hollow main body member; and said roller member is positioned to provide a predetermined space between said end portion and a first external surface upon which said roller member rolls.

4. The tool according to claim 2, wherein:

said main body member is provided with an exterior end portion which is disposed between said first and second sides of said substantially hollow main body member; and said roller member is positioned to provide a predetermined space between said end portion and a first external surface upon which said roller member rolls.

5. A vacuum edge cleaning attachment tool comprising:

a substantially hollow main body member having a central elongated axis;

a suction port portion which extends from a first side of said substantially hollow main member and which is disposed substantially transverse to said central elongated axis thereof;

at least one roller member which is disposed on a second side of said substantially hollow main member which is substantially opposite said first side of said substantially hollow main member; and said suction port portion includes an angled suction port for vacuum cleaning an edge area at or near the intersection of a first external surface upon which said roller member rolls and a second external surface disposed substantially perpendicular to said first external surface.

6. The tool according to claim 5, wherein:

said suction port portion is beveled.

7. The tool according to claim 6, wherein:

said roller member is positioned to roll along said first external surface; and said suction port portion includes at least one guide contact portion which is positioned to move along and in contact with said second external surface disposed substantially perpendicular to said first external surface.

8. The tool according to claim 5, wherein:

said main body member is provided with an exterior end portion which is disposed between said first and second sides of said substantially hollow main body member; and said roller member is positioned to provide a predetermined space between said end portion and said first external surface upon which said roller member rolls.

9. The tool according to claim 8, wherein:

said suction port portion is beveled.

10. The tool according to claim 9, wherein:

said roller member is positioned to roll along said first external surface; and said suction port portion includes at least one guide contact portion which is positioned to move along and in contact with said second external surface disposed substantially perpendicular to said first external surface.

11. The tool according to claim 8, wherein:

said roller member is positioned to roll along said first external surface; and said suction port portion includes at least one guide contact portion which is positioned to move along and in contact with said second external surface disposed substantially perpendicular to said first external surface.

12. The tool according to claim 5, wherein:

said roller member is positioned to roll along said first external surface; and said suction port portion includes at least one guide contact portion which is positioned to move along and in contact with said second external surface disposed substantially perpendicular to said first external surface.

13. A vacuum edge cleaning attachment tool, comprising:

a substantially hollow main body member having a central elongated axis;

a suction port portion which extends from a first side of said substantially hollow main member and which is disposed substantially transverse to said central elongated axis thereof;

at least one roller member which is disposed on a second side of said substantially hollow main member which is substantially opposite said first side of said substantially hollow main member;

said roller member is positioned to roll along a first external surface; and said suction port portion includes at least one guide contact portion which is positioned to move along and in contact with a second external surface disposed substantially perpendicular to said first external surface.

14. The tool according to claim 13, wherein:

said suction port portion is beveled.

15. The tool according to claim 13, wherein:

said main body number is provided with an exterior end portion which is disposed between said first and second sides of said substantially hollow main body member; and said roller member is positioned to provide a predetermined space between said end portion and said first external surface upon which said roller member rolls.

16. The tool according to claim 15, wherein:

said suction port portion is beveled.

17. A vacuum edge cleaning attachment tool, comprising:

a substantially hollow main body member having a central elongated axis;

a suction port portion which extends from a first side of said substantially hollow main member and which is disposed substantially transverse to said central elongated axis thereof;

at least one roller member which is disposed on a second side of said substantially hollow main member which is substantially opposite said first side of said substantially hollow main member; and said main body member is provided with a portion which attaches to an external vacuum accessory hose.

18. The tool according to claim 17, wherein:

said suction port portion is beveled.

19. The tool according to claim 17, wherein:

said main body member is provided with an exterior end portion which is disposed between said first and second sides of said substantially hollow main body member; and said roller member is positioned to provide a predetermined space between said end portion and a first external surface upon which said roller member rolls.

20. The tool according to claim 19, wherein:

said suction port portion is beveled.

* * * * *